US009349581B2

(12) United States Patent
Kanagawa et al.

(10) Patent No.: US 9,349,581 B2
(45) Date of Patent: May 24, 2016

(54) INCANDESCENT LAMP

(71) Applicant: Toshiba Lighting & Technology Corporation, Yokosuka-shi, Kanagawa-ken (JP)

(72) Inventors: Hiroaki Kanagawa, Yokosuka (JP); Atsushi Ogawa, Yokosuka (JP)

(73) Assignee: Toshiba Lighting & Technology Corporation, Yokosuka-shi, Kanagawa-ken (JP)

( * ) Notice: Subject to any disclaimer, the term of this patent is extended or adjusted under 35 U.S.C. 154(b) by 0 days.

(21) Appl. No.: 14/489,692

(22) Filed: Sep. 18, 2014

(65) Prior Publication Data

US 2015/0279653 A1 Oct. 1, 2015

(30) Foreign Application Priority Data

Mar. 25, 2014 (JP) ..... 2014-061639
Mar. 25, 2014 (JP) ..... 2014-062222

(51) Int. Cl.

| | |
|---|---|
| ***H01K 1/40*** | (2006.01) |
| ***H01K 1/38*** | (2006.01) |
| ***H01K 1/20*** | (2006.01) |
| ***H01K 3/08*** | (2006.01) |

(52) U.S. Cl.
CPC .. *H01K 1/40* (2013.01); *H01K 1/20* (2013.01); *H01K 1/38* (2013.01); *H01K 3/08* (2013.01)

(58) Field of Classification Search
CPC ..... H01K 1/40; H01K 1/38; H01K 1/00
See application file for complete search history.

(56) References Cited

U.S. PATENT DOCUMENTS

| | | | | |
|---|---|---|---|---|
| 3,413,054 | A | 11/1968 | Richards et al. | |
| 3,611,010 | A | 10/1971 | Strobel | |
| 6,856,090 | B2 * | 2/2005 | Weyhrauch | H01K 1/18 313/271 |
| 2007/0103080 | A1 * | 5/2007 | Bako | C03C 27/044 313/623 |

FOREIGN PATENT DOCUMENTS

| | | | |
|---|---|---|---|
| GB | 349950 | A | 5/1931 |
| GB | 786994 | A | 11/1957 |
| JP | H06-162998 | A | 6/1994 |
| JP | H07-45244 | A | 2/1995 |
| JP | H09-045291 | A | 2/1997 |
| JP | 2008-066234 | A | 3/2008 |

OTHER PUBLICATIONS

Jul. 24, 2015—(EP) Partial Search Report—App 14185203.8.
Oct. 30, 2015—(EP) Extended European Search Report—App 14185203.8.

* cited by examiner

*Primary Examiner* — Anne Hines
(74) *Attorney, Agent, or Firm* — Banner & Witcoff, Ltd.

(57) ABSTRACT

According to one embodiment, an incandescent lamp includes: a bulb; a pair of lead sections that have respectively a holding section including nickel or molybdenum as a main component and an introduction section that is joined to one end portion of the holding section and is formed of Dumet wire; a filament section that is held between end portions of a pair of holding sections opposite to a side on which the introduction sections are joined inside the bulb; a fixing member that holds a pair of introduction sections inside the bulb; and a sealing section that seals one end portion of the bulb and holds the pair of introduction sections.

15 Claims, 2 Drawing Sheets

INCANDESCENT LAMP

CROSS-REFERENCE TO RELATED APPLICATIONS

This application is based upon and claims the benefit of priority from Japanese Patent Application No. 2014-061639, filed on Mar. 25, 2014; Japanese Patent Application No. 2014-062222, filed on Mar. 25, 2014; the entire contents of which are incorporated herein by reference.

FIELD

Embodiments described herein relate generally to an incandescent lamp.

BACKGROUND

There is an incandescent lamp including a bulb which is formed of soft glass and in which a sealing section is provided in an end portion thereof, a pair of lead sections of which one end side extends inside the bulb and the other end side is exposed from the sealing section, a filament section which is provided between end portions of the pair of lead sections inside the bulb, and a fixing member (also referred to as a bridge glass and the like) that is formed of the soft glass holding the pair of lead sections inside the bulb.

Here, the sealing section is formed by heating the end portion of the bulb formed of the soft glass and crushing the end portion of the heated bulb together with the pair of lead sections.

Furthermore, the fixing member is formed by crushing a member formed of the heated soft glass together with the pair of lead sections.

Thus, the pair of lead sections is formed of Dumet wire having a thermal expansion coefficient close to a thermal expansion coefficient of a glass.

However, if the pair of lead sections are formed of the Dumet wire, there is a problem that a portion holding the filament section of the pair of lead sections is open and failure occurs due to non-conduction while repeatedly turning on and off.

Thus, the pair of lead sections was proposed, in which the filament section side is formed of nickel and the sealing section side is formed of the Dumet wire.

However, a positional relationship was not considered between a portion formed of nickel in the pair of lead sections, a joint portion with a portion formed of the Dumet wire, and the fixing member formed of the soft glass.

Thus, when manufacturing an incandescent lamp, there is a concern that the fixing member is chipped and glass pieces are generated inside the bulb.

If there are the glass pieces inside the bulb, there is a concern that the glass pieces are attached to the filament section and then disconnection occurs.

Furthermore, since a portion of the lead sections having the filament section is heated by lighting on, there is a concern that an alloy is formed by nickel of the lead sections and tungsten of the filament section. If the alloy of nickel and tungsten is formed, the end portion of the filament section becomes brittle and disconnection may occur.

Furthermore, a technique was also proposed in which the pair of lead sections are formed of molybdenum.

However, if the pair of lead sections are simply formed of molybdenum, it is difficult to perform plastic working (bending working) when holding the filament section on the lead sections.

DETAILED DESCRIPTION

Figure 1:
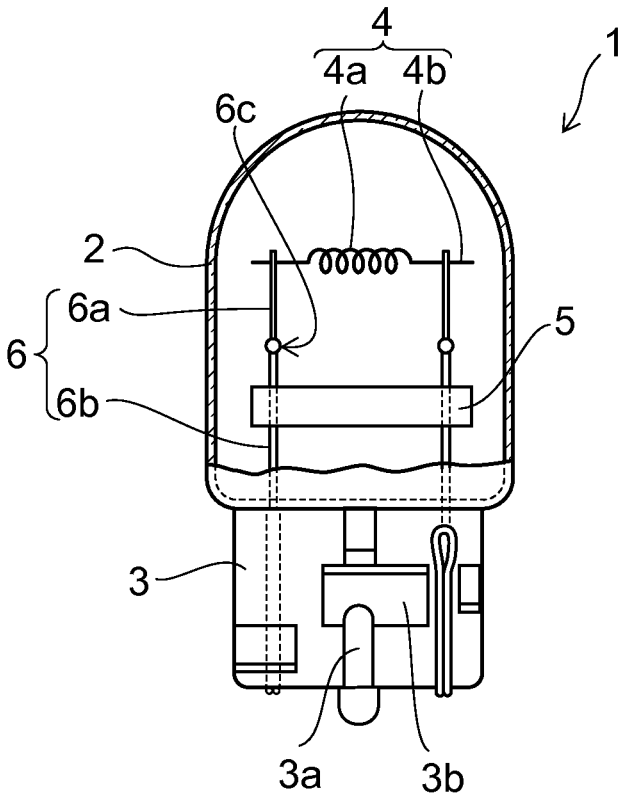
FIG. 1 is a schematic partial cross-sectional view when an incandescent lamp of an embodiment is viewed from a front side.

According to an embodiment, an incandescent lamp includes: a bulb; a pair of lead sections that have respectively a holding section including nickel or molybdenum as a main component and an introduction section that is joined to one end portion of the holding section and is formed of Dumet wire; a filament section that is held between end portions of a pair of holding sections opposite to a side on which the introduction sections are joined inside the bulb; a fixing member that holds a pair of introduction sections inside the bulb; and a sealing section that seals one end portion of the bulb and holds the pair of introduction sections.

In the incandescent lamp, the filament section is held by the holding section including nickel or molybdenum as a main component.

Thus, it is possible to prevent portions that hold the filament section so as to clamp end portions thereof from being open that occurs if the holding section is configured of a plurality of metals such as Dumet wire, which have different thermal expansion coefficients. Thus, it is possible to suppress occurrence of failure due to non-conduction.

Furthermore, since the introduction section formed of the Dumet wire is sealed by the fixing member and the sealing section, it is possible to prevent glass pieces from being generated inside the bulb when manufacturing the incandescent lamp. Thus, it is possible to suppress occurrence of disconnection in the filament section.

Furthermore, it is possible to suppress occurrence of leakage in the sealing section.

Furthermore, in the incandescent lamp, a joint section between the holding section and the introduction section may be provided between the fixing member and the filament section.

In this case, it is possible to reliably suppress occurrence of the glass pieces.

Furthermore, in the incandescent lamp, the fixing member and the sealing section may be formed of soft glass.

In this case, it is possible to reduce manufacturing cost.

Furthermore, in the incandescent lamp, an inert gas may be sealed inside the bulb. In this case, it is possible to increase a lifetime of the incandescent lamp.

Furthermore, in the incandescent lamp, the holding section and the introduction section may be joined by resistance welding.

In this case, it is possible to improve reliability of the joint section and achieve a decrease in the manufacturing cost.

According to another embodiment, an incandescent lamp includes: a bulb; a pair of lead sections that have respectively a holding section including molybdenum as a main component and an introduction section that is joined to one end portion of the holding section and is formed of Dumet wire; a filament section that is held between end portions of a pair of holding sections opposite to a side on which the introduction sections are joined inside the bulb; and a sealing section that seals one end portion of the bulb and holds the pair of introduction sections, in which a cross sectional dimension of the holding section is shorter than that of the introduction section.

According to the incandescent lamp, it is possible to improve connection strength of the holding section and the introduction section. Furthermore, it is possible to suppress occurrence of the disconnection in the filament section and it is possible to easily perform plastic working (bending working) of the holding section and manufacturing of the incandescent lamp.

In the incandescent lamp, when the cross sectional dimension of the holding section is D1 and the cross sectional dimension of the introduction section is D2, the following expression may be satisfied.

$$0.2 \leq D1/D2 \leq 0.9$$

In this case, it is possible to improve the connection strength of the holding section and the introduction section. Furthermore, it is possible to suppress occurrence of the disconnection in the filament section and it is possible to easily perform plastic working (bending working) of the holding section and manufacturing of the incandescent lamp.

Furthermore, the cross sectional dimension of the holding section may be 0.2 mm or greater and 0.5 mm or less.

In this case, it is possible to prevent the holding section from blowing and to easily perform the plastic working (bending working) of the holding section.

Furthermore, an inert gas may be sealed inside the bulb. In this case, it is possible to increase the lifetime of the incandescent lamp.

Furthermore, the holding section and the introduction section may be joined by resistance welding.

In this case, it is possible to improve reliability of the joint section and achieve a decrease in the manufacturing cost.

Hereinafter, an embodiment will be exemplified with reference to the drawings. Moreover, in each view, the same reference numerals are given to similar configuration elements and detailed description thereof will be appropriately omitted.

FIG. 1 is a schematic partial cross-sectional view when an incandescent lamp 1 of the embodiment is viewed from a front side.

Figure 2:
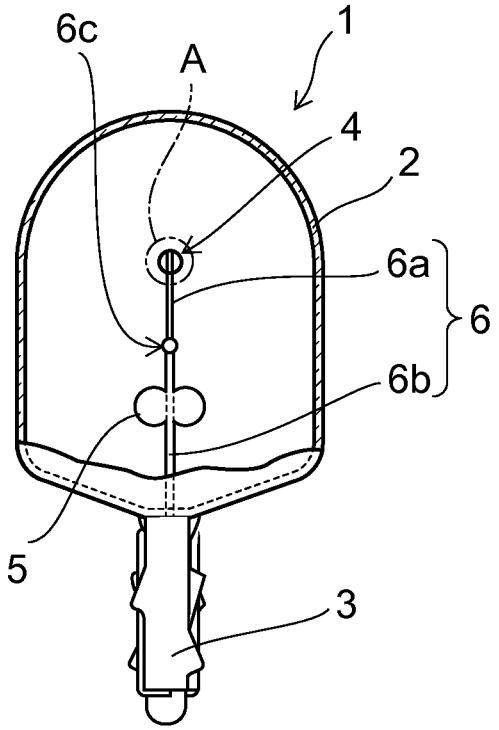
FIG. 2 is a schematic partial cross-sectional view when the incandescent lamp of the embodiment is viewed from a side.

FIG. 2 is a schematic partial cross-sectional view when the incandescent lamp 1 of the embodiment is viewed from a side.

Figure 3:
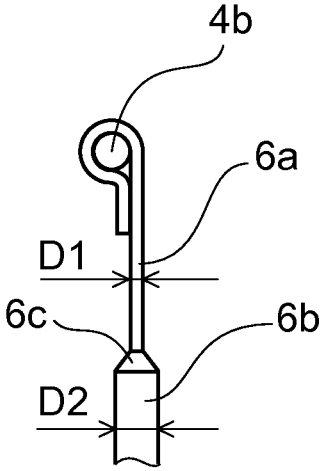
FIG. 3 is a schematic enlarged view of A portion in FIG. 2.

FIG. 3 is a schematic enlarged view of A portion in FIG. 2.

The incandescent lamp 1 according to the embodiment may be used as a brake lamp, a direction indicating lamp, or a tail lamp provided in a vehicle such as a two-wheel vehicle or a four-wheel vehicle (automobile).

Furthermore, the incandescent lamp 1 illustrated in FIGS. 1 and 2 is a wedge-base lamp having no cap.

However, applications and forms of the incandescent lamp 1 are not limited to the illustrated example.

The incandescent lamp 1 according to the embodiment can be widely applied to an example in which a fixing member 5 that is formed of soft glass holding a plurality of lead sections 6 is provided inside the bulb 2.

For example, the incandescent lamp 1 according to the embodiment may be used as a lighting device (lighting tool) used indoors or outdoors and may be a lamp having the cap.

In this case, the incandescent lamp 1 according to the embodiment is preferably used in a lighting device to which vibration is applied, such as a lighting device for the vehicle.

As illustrated in FIGS. 1 and 2, the incandescent lamp 1 is provided with the bulb 2, a sealing section 3, a filament section 4, the fixing member 5, and the lead sections 6.

The bulb 2 is a cylindrical body of which one end has a hemispherical shape.

The shape of the bulb 2 is not limited to the illustrated example and, for example, may be an A-type, a G-type, a PS-type, an R-type, a T-type, a composite type thereof, or a flat plate shape made of a plate-like body, a dish-like body, or the like.

The sealing section 3 is provided in the other end of the bulb 2.

Furthermore, the bulb 2 is formed of a translucent material.

Thus, the bulb 2 is an air-tight container having translucency.

For example, the bulb 2 can be formed of soft glass such as soda-lime glass and alkali alkaline-earth silicic acid glass (also referred to as lead-free glass and the like).

Physical properties of the soft glass are, for example, a softening point of 665° C., an annealing point of 480° C., a strain point of 440° C., thermal conductivity (100° C.) of 1.1 (W/(m·K)), and a thermal expansion coefficient (30° C. to 380° C.) of $5\times10^{-6}$/° C. or greater (for example, $9.45\times10^{-6}$/° C.).

In this case, the bulb 2 may have translucency. For example, the bulb 2 may be colorless and transparent or may be colored. Furthermore, a surface or an inner surface of the bulb 2 may be provided with coating such as a colored film, a reflective film, a diffuser film, a phosphor film, or unevenness. The bulb 2 may be formed of a material including a scattering material, phosphor, or the like.

The inside of the bulb 2 that is the air-tight container is in a vacuum state or sealed with an inert gas.

For example, the sealed inert gas may be xenon (Xe) gas, krypton (Kr) gas, argon (Ar) gas, a mixed gas thereof, or the like.

Furthermore, the sealed inert gas may further include nitrogen ($N_2$) gas and the like.

If the inert gas is sealed, a pressure of the inside of the bulb 2 may be approximately 0.05 MPa to 0.30 MPa.

If the inert gas is sealed, it is possible to achieve heat dissipation by convection as well as radiation.

Thus, even if power consumption of the incandescent lamp 1 is 15 watts (W) or greater, it is possible to suppress an increase in the temperature of the incandescent lamp 1.

The sealing section 3 has a rectangular parallelepiped shape.

As described above, the sealing section 3 seals one end portion of the bulb 2.

For example, the sealing section 3 may be formed by heating the end portion of the bulb 2 and crushing the end portion of the heated bulb 2 together with a pair of introduction sections 6*b*.

In this case, the sealing section 3 is also formed of the soft glass.

The sealing section 3 is provided with an exhaust tube 3*a* passing through the inside of the sealing section 3 and communicating with the inside of the bulb 2. The exhaust tube 3*a* is used when exhausting the inside of the bulb 2 or sealing the inert gas on the inside of the bulb 2. The end portion of the exhaust tube 3*a* on an outside air side is sealed.

Furthermore, the sealing section 3 is provided with a convex claw section 3*b* that is used when holding the incandescent lamp 1 on the side of the lighting tool.

The filament section 4 has a body section 4*a* and end portions 4*b* provided respectively on both ends of the body section 4*a*.

The body section 4*a* has a coil shape.

The body section 4*a* is formed by winding a wire material.

The end portion 4*b* has a linear shape and extends in an axial direction of the body section 4*a*.

The body section 4*a* and the end portions 4*b* may be integrally formed.

For example, the filament section 4 (the body section 4*a* and the end portions 4*b*) may include tungsten (W) as a main component.

The fixing member 5 is provided inside the bulb 2.

The fixing member 5 holds the introduction sections 6*b* of a pair of lead sections 6.

The fixing member 5 is provided between a joint section 6*c* between a holding section 6*a* and the introduction section 6*b*, and the sealing section 3.

For example, the fixing member 5 may be formed of the soft glass.

For example, the fixing member 5 may be formed by crushing a member made of the heated soft glass together with the pair of introduction sections 6*b*.

In this case, the bulb 2, the sealing section 3, and the fixing member 5 may be formed of the same material.

The lead section 6 has the holding section 6*a* and the introduction section 6*b*.

The holding section 6*a* has a linear shape.

For example, a cross sectional dimension (diameter dimension) of the linear holding section 6*a* may be 0.2 mm or greater and 0.5 mm or less.

As illustrated in FIG. 3, one end of the holding section 6*a* is bent and holds the end portion 4*b* of the filament section 4 so as to be clamped.

The other end of the holding section 6*a* is joined to one end of the introduction section 6*b*.

As described below, the holding section 6*a* may include nickel (Ni) or molybdenum (Mo) as a main component.

One end of the introduction section 6*b* is joined to the holding section 6*a* and the other end of the introduction section 6*b* is exposed from the sealing section 3. The portion of the introduction section 6*b* exposed from the sealing section 3 is a terminal for connection with an external power supply and the like.

As described below, the introduction section 6*b* is formed of the Dumet wire.

For example, joining between the holding section 6*a* and the introduction section 6*b* may be performed using a resistance welding method and the like.

The joint section 6*c* between the holding section 6*a* and the introduction section 6*b* is provided between the fixing member 5 and the filament section 4.

That is, the fixing member 5 and the sealing section 3 are sealed with the introduction section 6*b*, but are not sealed with the holding section 6*a*.

Here, when lighting the incandescent lamp 1, a voltage is applied to the filament section 4 through the lead sections 6.

When the voltage is applied to the filament section 4, a current flows through the filament section 4 and heat and light emission are generated.

Thus, the holding sections 6*a* holding the end portions 4*b* of the filament section 4 are heated.

In this case, the holding sections 6*a* are formed of the Dumet wire, and there is a concern that the failure occurs due to the non-conduction as described below.

The Dumet wire is a composite wire in which iron-nickel alloy is a metal core and copper is coated thereon. Furthermore, it is possible to apply nickel plating, oxidized finishing, borate finishing, or the like on a surface of the Dumet wire.

Thus, if the holding section 6*a* is formed of the Dumet wire on which the nickel plating is performed, since the thermal expansion coefficients of the metal core of the Dumet wire formed of the metal-nickel alloy, a copper layer coating thereon, and nickel plating around the copper layer are different from each other, there is a concern that the portion (the bent portion) of the holding section 6*a* that holds the end portion 4*b* of the filament section 4 so as to clamp the end portion 4*b* thereof is open and the failure occurs due to the non-conduction by heating associated with the lighting of the incandescent lamp 1.

Thus, in the embodiment, the holding section 6*a* is formed using nickel or molybdenum.

If the holding section 6*a* is formed of nickel or molybdenum, since the holding section 6*a* is configured of a single metal, it is possible to suppress a phenomenon in which the portion (the bent portion) of the holding section 6*a* that holds the end portion 4*b* of the filament section 4 so as to clamp the end portion 4*b* thereof is open compared to a case of the Dumet wire that is configured of a plurality of metals of which the thermal expansion coefficients are different from each other. As a result, it is possible to suppress the occurrence of failure due to the non-conduction of the filament section 4.

However, the thermal expansion coefficient of the nickel is approximately $13.3\times10^{-6}/°0$ C. and the thermal expansion coefficient of the molybdenum is approximately $4.9\times10^{-6}/°$ C.

In contrast, the thermal expansion coefficient of the soft glass that is a material of the sealing section 3 and the fixing member 5 is approximately $9.45\times10^{-6}/°$ C.

Thus, since a difference between the thermal expansion coefficient of nickel or molybdenum and the thermal expansion coefficient of the soft glass is great, if an entirety of the lead section 6 is formed of nickel or molybdenum, there is a concern that sealing between the lead section 6 and the sealing section 3, and sealing between the lead section 6 and the fixing member 5 become incomplete.

If the sealing between the lead section 6 and the sealing section 3 becomes incomplete, there is a concern that leakage occurs in the sealing section 3.

If the sealing between the lead section 6 and the fixing member 5 becomes incomplete, the fixing member 5 is easily chipped when manufacturing the incandescent lamp 1. When chipped the fixing member 5, the glass pieces occur on the inside of the bulb 2 and the disconnection may occur due to attachment of the glass pieces to the filament section 4.

Here, the thermal expansion coefficient of the Dumet wire is approximately $9.3\times10^{-6}/°$ C. and a difference between the thermal expansion coefficient of the Dumet wire and the thermal expansion coefficient of the soft glass is small.

Thus, if the introduction section 6*b* that is sealed with the sealing section 3 and the fixing member 5 is formed of the Dumet wire, it is possible to prevent the sealing from being incomplete.

As a result, it is possible to prevent the leakage from occurring in the sealing section 3.

Furthermore, since occurrence of the glass pieces inside the bulb 2 can be suppressed when manufacturing the incandescent lamp 1, it is possible to suppress the occurrence of the disconnection in the filament section 4.

Table 1 is a table illustrating effects of the incandescent lamp 1 according to the embodiment.

TABLE 1

| | Length of holding section 6a formed of molybdenum | | | | |
|---|---|---|---|---|---|
| | 2 mm | 8 mm | 12 mm | 17 mm Exists between fixing member 5 and sealing section 3 | 20 mm The joint section 6c exists inside sealing section 3 |
| | Joint section 6c exists between fixing member 5 and filament section 4 | | | | |
| Material of portion sealed with fixing member 5 | Dumet wire (introduction section 6b) | Dumet wire (introduction section 6b) | Dumet wire (introduction section 6b) | Molybdenum (holding section 6a) | Molybdenum (holding section 6a) |
| Material of portion sealed with sealing section 3 | Dumet wire (introduction section 6b) | Dumet wire (introduction section 6b) | Dumet wire (introduction section 6b) | Dumet wire (introduction section 6b) | Molybdenum (holding section 6a) + Dumet wire (introduction section 6b) |
| Occurrence probability of glass pieces | 0/100 | 0/100 | 0/100 | 5/100 | 5/100 |

Moreover, occurrence probabilities of the glass pieces are those when manufacturing the incandescent lamp 1.

As illustrated in Table 1, if the joint section 6*c* between the holding section 6*a* and the introduction section 6*b* is provided between the fixing member 5 and the filament section 4, it is possible to suppress occurrence of the glass pieces inside the bulb 2.

Thus, it is possible to suppress the occurrence of the disconnection due to the attachment of the glass pieces to the filament section 4.

As described above, when lighting the incandescent lamp 1, the voltage is applied to the filament section 4 through the lead sections 6.

When the voltage is applied to the filament section 4, the current flows through the filament section 4 and heat and light emission are generated.

Thus, the holding section 6*a* holding the end portion 4*b* of the filament section 4 is heated.

In this case, if the holding section 6*a* is formed of the Dumet wire, there is a concern that the failure occurs due to the non-conduction as described below.

For example, the Dumet wire is the composite wire in which iron-nickel alloy is the metal core and copper is coated thereon. Furthermore, it is possible to apply nickel plating, oxidized finishing, borate finishing, or the like on the surface of the Dumet wire.

Thus, if the holding section 6*a* is formed of the Dumet wire on which the nickel plating is performed, since the thermal expansion coefficients of the metal core of the Dumet wire formed of the metal-nickel alloy, the copper layer coating thereon, and nickel plating around the copper layer are different from each other, there is a concern that the portion (the bent portion) of the holding section 6*a* that holds the end portion 4*b* of the filament section 4 so as to clamp the end portion 4*b* thereof is open and the failure occurs due to the non-conduction by heating associated with the lighting of the incandescent lamp 1.

In this case, if the holding section 6*a* is formed of molybdenum, since the holding section 6*a* is configured of a single metal, it is possible to suppress the phenomenon in which the portion (the bent portion) of the holding section 6*a* that holds the end portion 4*b* of the filament section 4 so as to clamp the end portion 4*b* thereof is open compared to a case of the Dumet wire that is configured of a plurality of metals of which the thermal expansion coefficients are different from each other. As a result, it is possible to suppress the occurrence of failure due to the non-conduction of the filament section 4.

However, if the holding section 6*a* is formed of nickel, there is a concern that an alloy of nickel and tungsten that is a material of the filament section 4 is formed by heating.

If the alloy of nickel and tungsten is formed, the end portion 4*b* of the filament section 4 becomes brittle and disconnection may occur.

Thus, the holding section 6*a* may include molybdenum as a main component. Moreover, the holding section 6*a* may also be formed of pure molybdenum.

In this case, a melting point of nickel is approximately 1455° C. and a melting point of molybdenum is approximately 2623° C.

Thus, it is possible to prevent an alloy of tungsten from being formed by using molybdenum having a higher melting point.

As a result, it is possible to suppress the occurrence of the disconnection in the filament section 4.

Table 2 is results of an impact test based on the SAE standards.

TABLE 2

| Test time | 0 h | 5 h | 15 h | 25 h | 35 h | 45 h | 550 h |
|---|---|---|---|---|---|---|---|
| Holding section 6a including nickel as main component | 0/5 | 0/5 | 3/5 | 3/5 | 4/5 | 5/5 | 5/5 |
| Holding section 6a including molybdenum as main component | 0/5 | 0/5 | 0/5 | 0/5 | 0/5 | 0/5 | 0/5 |

The impact test was performed based on the SAE standards and an impact acceleration of 800 G was applied when the incandescent lamp 1 is unlit (lighting off).

Lighting conditions were configured such that lighting for two minutes and non-lighting for 30 seconds were repeated.

Test results were evaluated by "the number of disconnection/the number of tests".

As illustrated in Table 2, if the holding section 6*a* includes molybdenum as a main component, it is possible to significantly extend the time until the disconnection and to significantly extend the lifetime of the incandescent lamp 1.

However, molybdenum has a property that it is difficult to perform plastic working (bending working).

Thus, as illustrated in FIG. 3, there is a problem that the holding section 6*a* is likely to be broken when bending the one end of the holding section 6*a*.

Table 2 represents a yield (yield rate) when performing the bending working of one end of the holding section 6*a* for holding the end portion 4*b* of the filament section 4.

TABLE 3

| Processing temperature (° C.) | Cross sectional dimension (diameter dimension) of holding section 6a | | |
|---|---|---|---|
| | ϕ0.3 mm | ϕ0.4 mm | ϕ0.5 mm |
| Room temperature | 100% | 80% | 80% |
| 500 | 100% | 90% | 80% |
| 600 | 100% | 100% | 90% |
| 650 | 100% | 100% | 90% |

As illustrated in Table 3, if the cross sectional dimension (diameter dimension) of the holding section 6*a* is 0.5 mm or less, it is possible to improve the yield.

In this case, if the cross sectional dimension (diameter dimension) of the holding section 6*a* is 0.3 mm or less, it is possible to obtain a high yield even if the working is performed at a room temperature.

On the other hand, if the cross sectional dimension (diameter dimension) of the holding section 6*a* is too small, the holding section 6*a* is likely to be blown.

For example, when power consumption of the incandescent lamp 1 is 15 watts (W) or greater, if the cross sectional dimension (diameter dimension) of the holding section 6*a* is too small, the holding section 6*a* is likely to be blown.

According to findings obtained by the inventors, it is preferable that the cross sectional dimension (diameter dimension) of the holding section 6*a* be 0.1 mm or greater.

In this way, it is possible to prevent the holding section 6*a* from being blown even if the power consumption of the incandescent lamp 1 is 15 watts (W) or greater.

Here, the thermal expansion coefficient of molybdenum is approximately $4.9\times10^{-6}$/° C.

On the other hand, the thermal expansion coefficient of the soft glass that is the material of the sealing section 3 and the fixing member 5 is approximately $9.45\times10^{-6}$/° C.

Thus, since the difference between the thermal expansion coefficient of molybdenum and the thermal expansion coefficient of the soft glass is great, if the entirety of the lead section 6 is formed of molybdenum, there is a concern that sealing between the lead section 6 and the sealing section 3, and sealing between the lead section 6 and the fixing member 5 become incomplete.

If sealing between the lead section 6 and the sealing section 3 becomes incomplete, there is a concern that leakage occurs in the sealing section 3.

If sealing between the lead section 6 and the fixing member 5 becomes incomplete, the fixing member 5 is likely to be chipped when manufacturing the incandescent lamp 1. If the fixing member 5 is chipped, there is a concern that the glass pieces occur inside the bulb 2 and the disconnection occurs by attachment of the glass pieces to the filament section 4.

Here, the thermal expansion coefficient of the Dumet wire is approximately $9.3\times10^{-6}$/° C. and a difference between the thermal expansion coefficient of the Dumet wire and the thermal expansion coefficient of the soft glass is small.

Thus, if the introduction section 6*b* that is sealed with the sealing section 3 and the fixing member 5 is formed of the Dumet wire, it is possible to prevent sealing from becoming incomplete.

As a result, it is possible to prevent the leakage from occurring in the sealing section 3.

Furthermore, since occurrence of the glass pieces inside the bulb 2 can be suppressed when manufacturing the incandescent lamp 1, it is possible to suppress occurrence of the disconnection in the filament section 4.

Here, as described above, the Dumet wire is the composite wire in which iron-nickel alloy is the metal core and copper is coated thereon, and nickel plating is performed around copper.

Thus, the melting point of the Dumet wire is lower than that of molybdenum.

Therefore, it is preferable that the cross sectional dimension (diameter dimension) of the introduction section 6*b* formed of the Dumet wire be longer than that of the holding section 6*a* including molybdenum as a main component. In other words, the cross sectional dimension (diameter dimension) of the holding section 6*a* including molybdenum as a main component may be shorter than that of the introduction section 6*b* formed of the Dumet wire.

Table 3 represents connection strength of the joint section 6*c* between the holding section 6*a* and the introduction section 6*b* when performing joint welding by respectively changing the cross sectional dimensions (diameter dimensions) of the holding section 6*a* and the introduction section 6*b*.

TABLE 4

| D1/D2 | Connection strength (A: Considerably high, B: high, C: low | | | | | |
|---|---|---|---|---|---|---|
| | D1 = ϕ0.1 mm | D1 = ϕ0.2 mm | D1 = ϕ0.3 mm | D1 = ϕ0.4 mm | D1 = ϕ0.5 mm | D1 = ϕ0.6 mm |
| 1.20 | C | C | C | C | C | C |
| 1.10 | C | C | C | C | C | C |
| 1.00 | C | C | C | C | C | C |
| 0.90 | C | B | B | B | B | C |
| 0.80 | C | B | B | B | B | C |
| 0.70 | C | A | A | A | A | C |
| 0.60 | C | A | A | A | A | C |
| 0.50 | C | A | A | A | A | C |
| 0.40 | C | B | A | A | B | C |
| 0.20 | C | B | B | B | B | C |
| 0.15 | C | C | C | C | C | C |
| 0.10 | C | C | C | C | C | C |

As illustrated in Table 4, when the cross sectional dimension (diameter dimension) of the holding section 6*a* is D1 and the cross sectional dimension (diameter dimension) of the introduction section 6*b* is D2, if the following expression is satisfied, the connection strength is increased and it is preferable.

$$0.2\leq D1/D2\leq 0.9$$

Furthermore, if the following expression is satisfied, the connection strength is further increased and then it is preferable.

$$0.4\leq D1/D2\leq 0.7$$

If the holding section 6*a* is molybdenum, since the melting point of molybdenum is high, weldability is poor, but if the cross sectional dimension (diameter dimension) D2 of the introduction section 6*b* is greater than the cross sectional dimension (diameter dimension) D1 of the holding section 6*a*, as illustrated in FIG. 3, since welding is performed in the joint section 6*c* between the holding section 6*a* and the introduction section 6*b* in a state where the introduction section 6*b* that is configured of the Dumet wire having a low melting point covers a periphery of the holding section 6*a* configured of molybdenum having a high melting point, it is possible to improve the connection strength. However, if the cross sectional dimension (diameter dimension) D2 of the introduction section 6*b* is too great, in other words, if D1/D2 is too small, the weldability is deteriorated and the connection strength is decreased by removing the heat when performing welding to the introduction section 6*b*.

Next, a manufacturing method of the incandescent lamp 1 is exemplified.

First, the filament section 4 is held in the holding section 6*a* of the pair of lead sections 6 and the fixing member 5 is formed by crushing the member formed of the heated soft glass together with the introduction section 6*b* of the pair of lead sections 6.

Next, the filament section 4 and the fixing member 5 are inserted into the inside of the cylindrical soft glass tube.

At this time, the introduction section 6*b* is to be drawn out of the soft glass tube.

Furthermore, the exhaust tube 3*a* formed of the soft glass is disposed in an opening portion on a side on which the introduction section 6*b* of the soft glass tube is drawn out.

Next, both end portions of the soft glass tube are heated by a gas burner and the bulb 2 of which one end is sealed in a hemispherical shape is formed by being clamped by a pair of pinchers. Furthermore, the sealing section 3 is formed in the other end of the bulb 2.

The pair of introduction sections 6*b* are extended from the formed sealing section 3 toward the outside.

Next, the inside of the bulb 2 is exhausted through the exhaust tube 3*a* and the inert gas is supplied on the inside of the bulb 2 if necessary.

Next, the exhaust tube 3*a* is burned off by a burner and the bulb 2 and the exhaust tube 3*a* are annealed.

Next, terminals are formed by bending the pair of introduction sections 6*b* extending from the sealing section 3 toward the outside.

As described above, it is possible to manufacture the incandescent lamp 1.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions. Moreover, above-mentioned embodiments can be combined mutually and can be carried out.

What is claimed is:

1. An incandescent lamp comprising:

a bulb;

a pair of lead sections that have respectively a holding section and an introduction section that is joined to one end portion of the holding section and is formed of Dumet wire, the holding section including molybdenum as a main component;

a filament section that is held between end portions of a pair of holding sections opposite to a side on which the introduction sections are joined inside the bulb;

a fixing member that holds a pair of introduction sections inside the bulb; and a sealing section that seals one end portion of the bulb and holds the pair of introduction sections.

2. The lamp according to claim 1, wherein a joint section between the holding section and the introduction section is provided between the fixing member and the filament section.

3. The lamp according to claim 1, wherein the fixing member and the sealing section are formed of soft glass.

4. The lamp according to claim 1, wherein a cross sectional dimension of the holding section is shorter than that of the introduction section.

5. The lamp according to claim 1, wherein, when the cross sectional dimension of the holding section is D1 and the cross sectional dimension of the introduction section is D2, the following expression is satisfied:

$$0.2 \leq D1/D2 \leq 0.9.$$

6. The lamp according to claim 1, wherein the cross sectional dimension D1 of the holding section is 0.2 mm or greater and 0.5 mm or less.

7. The lamp according to claim 1, wherein an inert gas is sealed inside the bulb.

8. The lamp according to claim 1, wherein the holding section and the introduction section are joined by resistance welding.

9. An incandescent lamp comprising:

a bulb;

a pair of lead sections that have respectively a holding section including molybdenum as a main component and an introduction section that is joined to one end portion of the holding section and is formed of Dumet wire;

a filament section that is held between end portions of a pair of holding sections opposite to a side on which the introduction sections are joined inside the bulb; and a sealing section that seals one end portion of the bulb and holds the pair of introduction sections, wherein a cross sectional dimension of the holding section is shorter than that of the introduction section.

10. The lamp according to claim 9, wherein, when the cross sectional dimension of the holding section is D1 and the cross sectional dimension of the introduction section is D2, the following expression is satisfied:

$$0.2 \leq D1/D2 \leq 0.9.$$

11. The lamp according to claim 9, wherein the cross sectional dimension of the holding section is 0.2 mm or greater and 0.5 mm or less.

12. The lamp according to claim 9, further comprising:

a fixing member that holds the pair of introduction sections inside the bulb, wherein a joint section between the holding section and the introduction section is provided between the fixing member and the filament section.

13. The lamp according to claim 12, wherein the fixing member and the sealing section are formed of soft glass.

14. The lamp according to claim 9, wherein an inert gas is sealed inside the bulb.

15. The lamp according to claim 9,
wherein the holding section and the introduction section are joined by resistance welding.

* * * * *